US007784202B2

(12) United States Patent
Van Beeten

(10) Patent No.: US 7,784,202 B2
(45) Date of Patent: Aug. 31, 2010

(54) LATH FOR STRETCHER FRAME

(75) Inventor: Jeroen Joost Van Beeten, Amsterdam (NL)

(73) Assignee: Hoopman V.O.F. (NL)

( * ) Notice: Subject to any disclaimer, the term of this patent is extended or adjusted under 35 U.S.C. 154(b) by 0 days.

(21) Appl. No.: 12/124,805

(22) Filed: May 21, 2008

(65) Prior Publication Data

US 2008/0289229 A1 Nov. 27, 2008

(30) Foreign Application Priority Data

May 23, 2007 (NL) ..... 2000659

(51) Int. Cl.
*D06C 3/08* (2006.01)
*D06C 3/00* (2006.01)

(52) U.S. Cl. ..... 38/102.4; 160/378

(58) Field of Classification Search ..... 38/102.1, 38/102.4, 102.91, 102.8; 160/372, 374.1, 160/375, 376, 378; 40/603; 101/128.1; 24/530
See application file for complete search history.

(56) References Cited

U.S. PATENT DOCUMENTS 82,602 A * 9/1868 Colby ..... 160/378
1,895,309 A 1/1933 Boomershine
2,149,985 A * 3/1939 Tepper ..... 160/374.1
2,218,451 A * 10/1940 Heyne ..... 101/415.1
3,273,497 A * 9/1966 Rosema et al. ..... 101/128.1
3,955,298 A * 5/1976 Kapstad ..... 40/782
4,144,660 A * 3/1979 Lamb ..... 38/102.5
5,502,906 A * 4/1996 Yamawaki ..... 38/102
6,070,351 A * 6/2000 Verret ..... 40/603

FOREIGN PATENT DOCUMENTS

FR 2837136 A3 9/2003

* cited by examiner

*Primary Examiner*—Ismael Izaguirre
(74) *Attorney, Agent, or Firm*—Akerman Senterfitt

(57) ABSTRACT

The invention relates to a stretcher lath to be used in a frame for a painter's canvas or the like, wherein the stretcher lath comprises a main part and attached thereto a flexible leg. The leg is flexible in a direction substantially perpendicular in the principal plane of the frame. The free end of the leg is located in or within the periphery of the frame.

Figure 1:
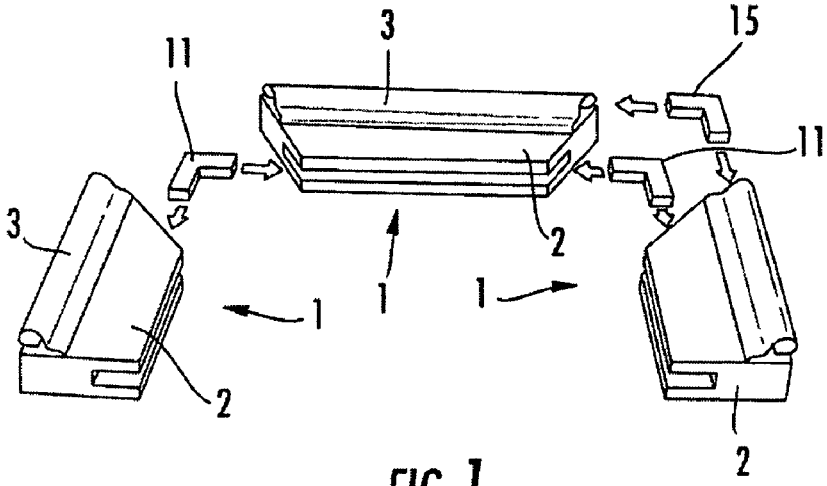

The invention further relates to a frame, comprising a stretcher lath according to the invention and to a painter's canvas fastened to a frame according to the invention. The invention also relates to a method for fastening a painter's canvas to a frame according to the invention.

10 Claims, 1 Drawing Sheet

LATH FOR STRETCHER FRAME

The present invention relates to a stretcher lath, known as a stretcher bar, to be used in a stretcher frame for a painter's canvas or the like, wherein the stretcher lath comprises a main part and attached thereto a flexible leg. The invention also relates to a frame for a painter's canvas comprising a stretcher lath according to the invention. The invention also relates to a method for fastening a painter's canvas around a frame according to the invention. The invention finally relates to a painter's canvas fastened to a frame according to this invention.

Hereinafter, the term mostly used is painter's canvas. This refers to a clean canvas as well as a canvas bearing an image, such as a painting either in progress or completely finished.

The use of stretcher laths capable of realising at least a partial automatic adjustment to an altered dimension of a painter's canvas is known in the art. A change in the level of moisture or the application of a preparatory coat, a coat of paint or varnish to a painter's canvas could generally alter the dimension. Likewise, the atmospheric humidity may influence the dimension of a painter's canvas. Most painter's canvases will either expand or shrink as a result of such changing conditions. It is especially when such painter's canvases expand that they may become slack. When the painter's canvas or the painting shrinks, tears and cracks may appear in the canvas as well as in the painting thereon.

The prior art stretcher lath able to at least partly absorb a dimensional alteration of the painter's canvas comprises a flexible leg, positioned perpendicularly to the plane of the painter's canvas. When the painter's canvas expands, the leg is able to move outward in the plane of the canvas such that it can become jammed in the frame.

The object of the invention is now to provide an improved stretcher lath.

It is a particular object of the invention to provide a stretcher lath that is better able to absorb dimensional changes of the painter's canvas.

It is a further object of the invention to provide an improved stretcher lath allowing a manual adjustment of the force exerted by the stretcher lath on a painter's canvas.

Other objectives will become clear from the following description.

In order to achieve at least one of the above-mentioned objectives, the invention provides a stretcher lath as mentioned in the preamble, wherein the leg is flexible in a direction substantially perpendicular to the principal plane of the frame. This provides the advantage that the length of the leg may be longer than with the stretcher lath currently known. This makes it possible to adjust the pre-tensioning applied to the canvas more accurately than with the known stretcher lath.

It is especially preferred for the free end of the leg to be located in or within the periphery of the frame. A flexure caused by a dimensional change of the canvas will then not cause the outside dimension of the painting, that is to say the periphery of the frame and the canvas, to exceed the original dimension. As a consequence, the whole will always fit into a picture frame.

According to a further preferred embodiment, the leg extends substantially in the plane of the frame, and at least its free end is situated at a higher position relative to the upper surface of the main part. In this way the painter's canvas will at all times be clear of the main part and the painters canvas is supported at the outermost edges of the frame only.

According to a further preferred embodiment, it is also preferred that an adjusting means is provided for adjusting the distance from the free end of the leg to the main part. This adjusting means may, for example, comprise a screw provided in the main part, which can be moved from the rear side of the frame in the direction of the leg which, in the case of a screw, occurs by rotation so as to force the leg further away from the main part. Such a feature may be useful when the leg is flexed to its original position and the painting, that is to say the canvas with possibly an image thereon, surrounds the frame without being under tension. Such an adjusting means can then provide suitable tensioning of the painting.

It is further preferred for the main part to be made of a substantially rigid material and the leg to be made of a flexible material. This ensures that a dimensional change of the painting can be absorbed by the flexible leg in a predictable manner. The occurrence of unexpected dimensional changes will thus be avoided.

It is also preferred for at least one of the main part and the leg to be made of a combination of materials. The main part may, for example, be made of a combination of aluminium and wood. Aluminium provides a rigid construction, while the wood facilitates a simple fastening of the painter's canvas to the main part, in practice this is usually done with staples.

According to a further aspect, the invention relates to a frame for a painter's canvas, comprising a stretcher lath in accordance with the invention, wherein the leg is positioned at the periphery of the frame. The advantage of such an embodiment is that a painter's canvas can be fastened around the frame in a simple but accurate and predictable manner.

According to a further aspect, the invention also relates to a method for fastening a painter's canvas around a frame as mentioned above. In accordance with the method of the invention, the canvas is placed over the frame and guided around the stretcher laths, after which the canvas is fastened at the rear side of the frame to the main part of the stretcher laths. This should be done in such a manner that the legs are at least partly flexed in order to pretension the canvas. The legs are preferably flexed to less than a maximal flexure. A maximal flexure, for example, may be a flexure wherein the leg is positioned up against the main part. If the flexure is less than this maximal flexure, an increase of the dimension of the canvas as well as a reduction of the dimension of the canvas can be absorbed by a flexure of the legs either in the direction away from the main part, or towards the main part, respectively.

The invention finally relates to a painter's canvas on a frame as described above.

The following description will render further advantages of the invention clear to a person skilled in the art. Additional embodiments of the invention will therefore also fall within the protective scope of this patent.

Hereinafter the invention will be explained with reference to a schematic drawing, which merely serves as example.

FIG. 1 shows a schematic, exploded view of a frame for a painter's canvas in perspective.

Figure 2A:
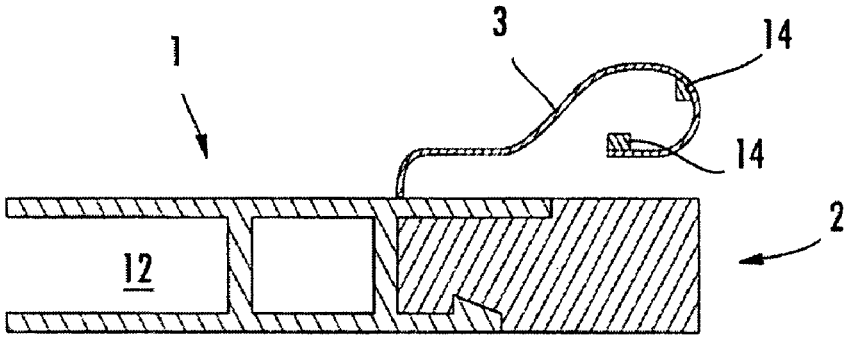
Figure 2B:
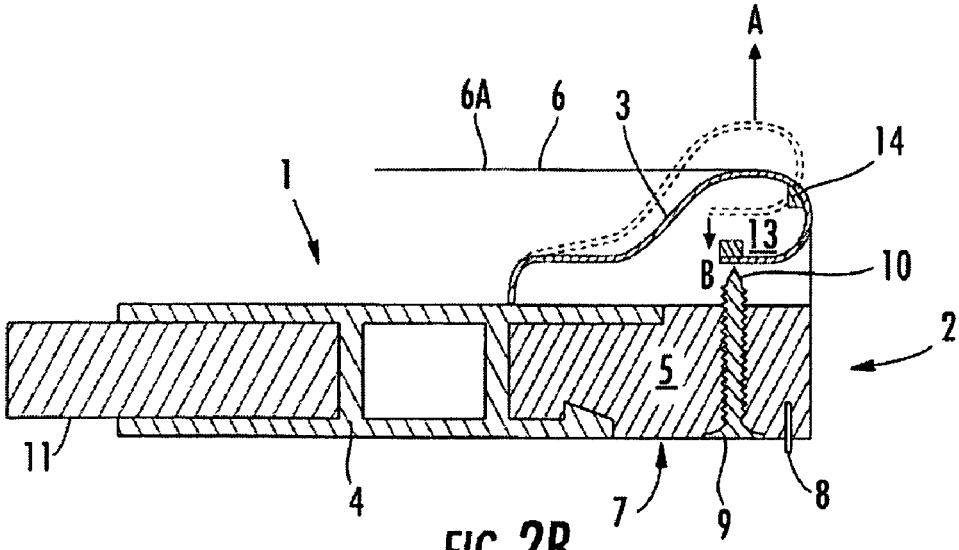

FIGS. 2A and 2B each show a cross section of an exemplary stretcher lath according to the invention.

The figures are merely schematic representations of one embodiment of a frame and stretcher lath according to the invention. For the sake of clarity, details of necessary or optional parts to be used in practice are not shown. A person skilled in the art will indubitably recognize the necessity or suitability of such parts.

FIG. 1 shows a schematic representation of an exploded view of a frame for a painter's canvas. The frame comprises stretcher laths 1, each of which is comprised of a main part 2 and a flexible leg 3. The main parts 2 of the stretcher laths can be connected with each other by means of coupling means 11 so as to form a square or rectangular frame. For additional reinforcement of the frame, extra coupling pieces may optionally be provided between opposite stretcher laths. Flexible legs 3 of adjacent stretcher laths 1 may also be connected with each other. The flexible legs 3 extend substantially in the plane of the frame. At least a free end of the flexible leg is situated at a higher position relative to an upper surface of the main part 2.

FIGS. 2A and 2B each show a schematic representation of a cross section through a stretcher lath 1, with some details.

The main part 2 is comprised of two parts, an aluminium part 4 and a wooden part 5. The aluminium part 4 provides mainly the rigidity and sturdiness of the frame. The wooden part 5 is principally intended for convenient fastening of the painter's canvas 6 (only shown in FIG. 2B). The surface 6A of the painter's canvas 6 will be treated. First, for example, a preparatory agent may be applied followed by a layer of paint. This layer of paint may optionally be coated with a layer of varnish or the like.

The painter's canvas 6 is guided around the leg 3, which is generally C-shaped, and then around the wooden part 5 to the underside 7 where the painter's canvas may be fastened with staples 8. The free end of the leg 3 terminates in a straight portion that extends underneath the higher portion of the flexible leg, between the flexible leg and the frame, in a direction substantially parallel to the principal plane of the frame.

The dotted line in FIG. 2B schematically indicates the untensioned state of the flexible leg 3. When the painter's canvas 6 is being fastened to the frame, the leg will undergo a slight flexure in the direction of the arrow B so as to pretension the painter's canvas 6. If during use or after completion of a painting the painter's canvas shrinks, the leg 3 will be able to continue moving in the direction of the arrow B so that the final tension on the painter's canvas 6 will remain substantially the same.

If, during use or after the application of an image on the canvas 5 the canvas stretches, or due to environmental conditions increases in size, the leg 3 will move in the direction of arrow A so that the tension on the canvas will remain substantially the same.

If the size of the canvas due to whichever circumstance increases, thereby causing the leg 3 to move to its state of rest, indicated with the dotted line in FIG. 2, it is still possible that the canvas becomes slack. In order to be able to absorb a further enlargement of the canvas, an adjusting means 9 is provided, in the example shown it is a screw that can be tightened, so that it moves further in the direction of the leg 3. When the screw 9 has been sufficiently rotated, the end 10 of the screw will abut to the straight portion of the free end of the leg 3 that extends back under the free end of the leg 3, bending the leg in the direction of arrow A. By providing an adequate number of adjusting means 9 at positions to be determined, a uniform predetermined tension can be applied to the canvas 6.

When stretcher laths 1 are connected with each other to form a frame, connecting means 11 can be used as shown in FIG. 1. FIG. 2B shows how the element 11 is inserted into a space 12 (shown in FIG. 2A). In order to also allow the legs 3 of adjacent stretcher laths 1 to move evenly, the embodiment shown in the FIGS. 2A and 2B is provided with recesses 14 forming a space 13 into which additional connecting means 15 may be placed. The ends of the stretcher laths 1 are mitred for a precise fit of the stretcher laths 1 against each other.

The invention thus provides a stretcher lath and a frame for a painter's canvas, affording considerable advantages compared with the stretcher laths and frames of the prior art.

A person skilled in the art will understand that the invention is not limited to the embodiment described above and shown in the drawing. The invention is limited by the appended claims only.

The invention claimed is:

1. A stretcher lath to be used in a frame for a painter's canvas, the stretcher lath comprising:

a main part; and a flexible leg extending from the main part, the flexible leg extending substantially parallel to a principal plane of the frame in use with at least a free end of the flexible leg situated at a higher position relative to an upper surface of the main part, wherein the flexible leg is formed in one piece with at least a portion of the main part, wherein the free end of the flexible leg has a curved, generally C-shape over which a canvas may be stretched, wherein the flexible leg is flexible in a direction substantially perpendicular to a principal plane of the frame, and wherein the curved end of the flexible leg terminates in a straight portion that extends underneath a higher portion of the flexible leg, between the flexible leg and the frame, in a direction substantially parallel to the principal plane of the frame.

2. A stretcher lath according to claim 1, wherein the free end of the leg is located in or within the periphery of the frame.

3. A stretcher lath according to claim 1, wherein an adjusting means is provided for adjusting the distance from the free end of the leg to the main part.

4. A stretcher lath according to claim 1, wherein the main part is substantially rigid.

5. A stretcher lath according to claim 4, wherein the main part is made of a combination of materials.

6. A stretcher frame for a painter's canvas, comprising a stretcher lath according to claim 1, wherein the free end of the leg is located at the periphery of the frame.

7. A method for fastening a painter's canvas around a stretcher frame according to claim 6, wherein the canvas is placed over the frame and guided around a plurality of the stretcher laths, and the canvas is fastened at the rear side of the frame to the main part of the stretcher laths such that the legs are at least partly flexed to induce pre-tensioning.

8. A method according to claim 7, wherein the legs are flexed to less than a maximal flexure.

9. A painter's canvas on a frame according to claim 6.

10. The stretcher lath according to claim 1, wherein the flexible leg and at least a portion of the main part are formed of aluminum.

* * * * *